US008110292B2

(12) United States Patent
Fujishiro et al.

(10) Patent No.: US 8,110,292 B2
(45) Date of Patent: Feb. 7, 2012

(54) HIGH STRENGTH STEEL PLATE, STEEL PIPE WITH EXCELLENT LOW TEMPERATURE TOUGHNESS, AND METHOD OF PRODUCTION OF SAME

(75) Inventors: Taishi Fujishiro, Tokyo (JP); Shinya Sakamoto, Tokyo (JP); Takuya Hara, Tokyo (JP); Hitoshi Asahi, Tokyo (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 12/736,359

(22) PCT Filed: Apr. 4, 2009

(86) PCT No.: PCT/JP2009/057420

§ 371 (c)(1),
(2), (4) Date: Sep. 30, 2010

(87) PCT Pub. No.: WO2009/125863

PCT Pub. Date: Oct. 15, 2009

(65) Prior Publication Data

US 2011/0023991 A1 Feb. 3, 2011

(30) Foreign Application Priority Data

Apr. 7, 2008 (JP) ..... 2008-099653
Apr. 6, 2009 (JP) ..... 2009-092511

(51) Int. Cl.
*B32B 15/18* (2006.01)
*C22C 38/00* (2006.01)
*B21C 37/08* (2006.01)

(52) U.S. Cl. ..... 428/683; 428/586; 428/684; 428/682; 428/638; 138/142; 138/171; 148/521; 148/547; 148/330; 148/332; 148/333; 148/334; 148/335; 148/336; 228/173.4; 228/144

(58) Field of Classification Search ..... None
See application file for complete search history.

(56) References Cited

U.S. PATENT DOCUMENTS 7,879,287 B2 * 2/2011 Kobayashi et al. ..... 420/84
(Continued)

FOREIGN PATENT DOCUMENTS

JP 2003-293078 10/2003
(Continued)

OTHER PUBLICATIONS

International Search Report dated Jul. 21, 2009 issued in corresponding PCT Application No. PCT/JP2009/057420.

*Primary Examiner* — Aaron Austin
(74) *Attorney, Agent, or Firm* — Kenyon & Kenyon LLP

(57) ABSTRACT

The present invention provides high strength steel plate with excellent low temperature toughness, high strength steel pipe using this as a base metal, and methods of production of the same. The steel plate of the present invention contains Mo: 0.05 to 1.00% and B: 0.0003 to 0.0100%, has a Ceq of 0.30 to 0.53, has a Pcm of 0.10 to 0.20, and has a metal structure which has an area percentage of polygonal ferrite of 20 to 90% and has a balance of a hard phase comprised of one or both of bainite and martensite. To obtain this steel plate, strain-introducing rolling is performed with a start temperature of not more than $Ar_3$+60° C., an end temperature of $Ar_3$ or more, and a reduction ratio of 1.5 or more, then the plate is air-cooled and then acceleratedly cooled from $Ar_3$−100° C. to $Ar_3$−10° C. in temperature by 10° C./s or more.

8 Claims, 2 Drawing Sheets

U.S. PATENT DOCUMENTS

| | | | | |
|---|---|---|---|---|
| 2003/0121577 | A1* | 7/2003 | Choi et al. | 148/653 |
| 2003/0131914 | A1* | 7/2003 | Jeong et al. | 148/541 |
| 2004/0144454 | A1* | 7/2004 | Jeong et al. | 148/654 |
| 2005/0173030 | A1* | 8/2005 | Jeong et al. | 148/541 |
| 2009/0114318 | A1* | 5/2009 | Arai et al. | 148/593 |
| 2010/0003535 | A1* | 1/2010 | Hara et al. | 428/586 |
| 2010/0236668 | A1* | 9/2010 | Hara et al. | 148/521 |
| 2010/0330388 | A1* | 12/2010 | Hara et al. | 428/586 |

FOREIGN PATENT DOCUMENTS

| | | |
|---|---|---|
| JP | 2003-306749 | 10/2003 |
| JP | 2004-131799 | 4/2004 |
| JP | 2004-143509 | 5/2004 |
| JP | 2005-60838 | 3/2005 |
| JP | 2005-146407 | 9/2005 |
| JP | 2006-291348 | 10/2006 |

* cited by examiner

HIGH STRENGTH STEEL PLATE, STEEL PIPE WITH EXCELLENT LOW TEMPERATURE TOUGHNESS, AND METHOD OF PRODUCTION OF SAME

This application is a national stage application of International Application No. PCT/JP2009/057420, filed 07 Apr. 2009, which claims priority to Japanese Application Nos. 2008-099653, filed 07 Apr. 2008; and 2009-092511, filed 06 Apr. 2009, each of which is incorporated by reference in its entirety.

TECHNICAL FIELD

The present invention relates to high strength steel plate and steel pipe with excellent low temperature toughness which are particularly suitable for line pipe for crude oil and natural gas transport.

BACKGROUND ART

In recent years, to improve the efficiency of transport of crude oil and natural gas, increasing the inside pressure of pipelines has been studied. Along with this, a higher strength is being demanded from steel pipe for line pipe. Furthermore, high strength steel pipe for line pipe is also being required to offer toughness, deformability, arrestability, etc. For this reason, steel plate and steel pipe made of mainly bainite and martensite formed with fine ferrite have been proposed.

For example, see Japanese Patent Publication (A) No. 2003-293078, Japanese Patent Publication (A) No. 2003-306749, and Japanese Patent Publication (A) No. 2005-14640.7. However, these relate to high strength steel pipes of the American Petroleum Institute (API) standard X100 (tensile strength 760 MPa or more) or better.

On the other hand, improved performance is being demanded from the high strength steel pipe of the API standard X70 (tensile strength 570 MPa or more) or API standard X80 (tensile strength 625 MPa or more) currently being used as material for trunk pipelines. As opposed to this, the method of heat treating the heat affected zone (HAZ) of steel pipe having a base metal comprised of bainite in which fine ferrite is formed so as to improve the deformability and low temperature toughness has been proposed. For example, see Japanese Patent Publication (A) No. 2004-131799.

In this way, the method has been proposed of starting from steel plate and steel pipe, mainly comprised of bainite and martensite and achieving both strength and toughness, and promoting the formation of ferrite so as to improve the deformability and other properties. However, recently, there has been increasingly stronger demand for low temperature toughness. Toughness of the base metal at the ultralow temperature of −60° C. or less is being sought. Further, the low temperature toughness of not only the base metal, but also the HAZ is extremely important.

SUMMARY OF INVENTION

To improve the HAZ toughness, it is effective to control the carbon equivalent Ceq and weld cracking sensitivity parameter Pcm and further add B and Mo to raise the hardenability and obtain a fine metal structure mainly comprised of bainite. However, on the other hand, it becomes difficult to promote the formation of ferrite in the base metal. In particular, if adding B and Mo jointly to raise the hardenability, ferrite transformation becomes harder. In particular, it is extremely difficult to air-cool steel plate right after the end of hot rolling so as to promote the formation of polygonal ferrite.

The present invention was made in consideration of this actual situation. It promotes the formation of polygonal ferrite in high strength steel plate obtained by controlling the carbon equivalent Ceq and weld cracking sensitivity parameter Pcm and, further, adding B and Mo to raise the hardenability. The present invention, in particular, improves the low temperature toughness of the base metal. Furthermore, it has as its object the provision of high strength steel pipes using this high strength steel plate as a base metal and methods of production of the same.

Note that, in the present invention, ferrite not stretched in the rolling direction and having an aspect ratio of 4 or less is called "polygonal ferrite". Here, the "aspect ratio" is the length of the ferrite grain divided by its width.

In the past, it has been difficult to promote the formation of polygonal ferrite in the metal structure of high strength steel plate obtained by simultaneously adding B and Mo and controlling the hardenability parameter Ceq and the weldability parameter of the weld cracking sensitivity parameter Pcm to their optimum ranges to improve the HAZ toughness. The present invention makes the metal structure of the steel plate having the chemical composition giving a high hardenability a dual phase structure of polygonal ferrite and the hard phase by optimizing the conditions of the hot rolling. The gist of the present invention is as follows:

(1) High strength steel plate with excellent low temperature toughness, having a chemical composition, by mass %, C: 0.01 to 0.08%, Si: 0.01 to 0.50%, Mn: 0.5 to 2.0%, S: 0.0001 to 0.005%, Ti: 0.003 to 0.030%, Mo: 0.05 to 1.00%, B: 0.0003 to 0.010%, and O: 0.0001 to 0.008%, limiting P: 0.050% or less and Al: 0.020% or less, and having a balance of iron and unavoidable impurities, having a Ceq, calculated by the following (formula 1), of 0.30 to 0.53, having a Pcm, found the following (formula 2), of 0.10 to 0.20, and having a metal structure with an area percentage of polygonal ferrite of 20 to 90% and a balance of a hard phase comprised of one or both of bainite and martensite:

$$Ceq=C+Mn/6+(Ni+Cu)/15+(Cr+Mo+V)/5 \ldots \quad \text{(formula 1)}$$

$$Pcm=C+Si/30+(Mn+Cu+Cr)/20+Ni/60+Mo/15+V/10+5B \ldots \quad \text{(formula 2)}$$

where, C, Si, Mn, Ni, Cu, Cr, Mo, V, and B are contents of the individual elements (mass %).

(2) High strength steel plate with excellent low temperature toughness as set forth in (1), further containing, by mass %, one or both of Cu: 0.05 to 1.5% and Ni: 0.05 to 5.0%.

(3) High strength steel plate with excellent low temperature toughness as set forth in (1) or (2), further containing, by mass %, one or more of Cr: 0.02 to 1.50%, W: 0.01 to 0.50%, V: 0.01 to 0.10%, Nb: 0.001 to 0.20%, Zr: 0.0001 to 0.050%, and Ta: 0.0001 to 0.050%.

(4) High strength steel plate with excellent low temperature toughness as set forth in any one of (1) to (3), further containing, by mass %, one or more of Mg: 0.0001 to 0.010%, Ca: 0.0001 to 0.005%, REM: 0.0001 to 0.005%, Y: 0.0001 to 0.005%, Hf: 0.0001 to 0.005%, and Re: 0.0001 to 0.005%.

(5) High strength steel plate with excellent low temperature toughness as set forth in any one of (1) to (4), characterized by having a metal structure with an area percentage of polygonal ferrite of 20 to 80%.

(6) High strength steel pipe with excellent low temperature toughness characterized by having a base metal comprised of steel plate as set forth in any one of (1) to (5).

(7) A method of production of high strength steel plate with excellent low temperature toughness characterized by taking a steel slab comprised of the chemical compositions as set forth in any one of (1) to (4), reheating it to 950° C. or more, hot rolling it, performing, as the final step in said hot rolling, strain-introducing rolling with a start temperature of not more than $Ar_3$+60° C., and end temperature of not less than $Ar_3$, and a reduction ratio of not less than 1.5, then air-cooling, then acceleratedly cooling from $Ar_3$−100° C. to $Ar_{3-10}$° C. in temperature by a 10° C./s or more cooling rate until a temperature of not more than a Bs calculated by the following (formula 3).

$$Bs(°\,C.)=830-270C-90Mn-37Ni-70Cr-83Mo \ldots \quad \text{(formula 3)}$$

where, C, Mn, Ni, Cr, and Mo are contents of the individual elements (mass %).

(8) A method of production of high strength steel pipe with excellent low temperature toughness characterized by forming steel plate produced by the method as set forth in (7) into a pipe shape by a UO process, welding the abutting parts from the inside and outside surfaces by submerged arc welding, then expanding the pipe.

DESCRIPTION OF EMBODIMENTS

To improve the toughness of high strength steel plate, in particular, to secure toughness at the very low temperature of −40° C., furthermore, −60° C., refinement of the crystal grains is necessary. However, a metal structure comprised of bainite and martensite is difficult to refine by rolling. Further, if forming soft ferrite, the toughness is improved. However, it was learned that if hot rolling in a temperature region where both austenite and ferrite are present and forming worked ferrite, the toughness deteriorations.

Therefore, the inventors turned their attention to a method of promoting the formation of polygonal ferrite after the end of the hot rolling at the time of cooling at a high temperature so as to improve the low temperature toughness of the high strength steel plate. However, in high strength steel plate raised in hardenability so as to secure the strength and toughness of the HAZ, promotion of the formation of polygonal ferrite is difficult.

To promote the formation of polygonal ferrite, it is effective to raise the dislocation density of austenite immediately after hot rolling the steel plate, that is, before the air-cooling. The inventors, first, studied the rolling conditions in the temperature region where the metal structure is austenite and no recrystallization occurs, that is, the non-recrystallized γ region.

Steel containing, by mass %, C: 0.01 to 0.08%, Si: 0.01 to 0.50%, Mn: 0.5 to 2.0%, S: 0.0001 to 0.005%, Ti: 0.003 to 0.030%, and O: 0.0001 to 0.008%, limited to P: 0.050% or less and Al: 0.020% or less, having a content of Mo of 0.05 to 1.00%, having a content of B of 0.0003 to 0.010%, having a hardenability parameter of the carbon equivalent Ceq of 0.30 to 0.53, and having a weldability parameter of the weld cracking sensitivity parameter Pcm of 0.10 to 0.20 was smelted and cast to produce a steel slab.

Next, a test piece of a height of 12 mm and a diameter of 8 mm was cut out from the obtained steel slab and subjected to working/heat treatment simulating hot rolling. As the working/heat treatment, the piece was worked once by a reduction ratio of 1.5, was cooled by 0.2° C./s corresponding to air-cooling, and furthermore was acceleratedly cooled at 15° C./s corresponding to water cooling. Note that, to avoid formation of worked ferrite, the working temperature was made a temperature of at least the transformation temperature $Ar_3$ at the time of cooling. The transformation temperature $Ar_3$ at the time of cooling was found from the heat expansion curve. After the working/heat treatment, the test piece was measured for the area percentage of polygonal ferrite. Note that, ferrite not stretched in the rolling direction and having an aspect ratio of 1 to 4 was defined as "polygonal ferrite".

Figure 1:
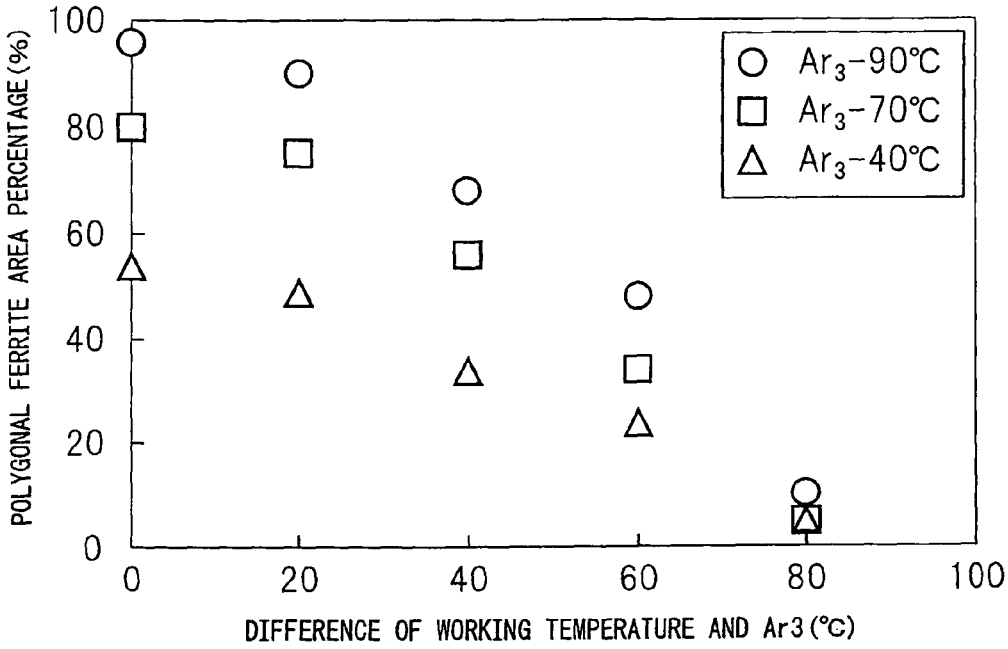
FIG. 1 is a view showing the relationship between a hot working temperature and a polygonal ferrite area percentage.

The inventors set the temperature for starting the accelerated cooling at 15° C./s corresponding to the water cooling at $Ar_3$−90° C., $Ar_3$−70° C., and $Ar_3$−40° C. and changed the temperature for performing the work (working temperature) to study the conditions at which polygonal ferrite is formed. The results are shown in FIG. 1. FIG. 1 plots the area percentage of polygonal ferrite against the difference between the working temperature and $Ar_3$. The circles, squares, and triangles show the results when making the start temperature of the accelerated cooling respectively $Ar_3$−90° C., $Ar_3$−70° C., and $Ar_3$−40° C. As shown in FIG. 1, it is learned that if making the working temperature of the hot working not more than $Ar_3$+60° C., an area percentage of at least 20% of polygonal ferrite is formed.

Furthermore, using a hot rolling mill, the inventors studied the relationship between the accelerated cooling start temperature and the area percentage of polygonal ferrite and the relationship between the area percentage of polygonal ferrite and the toughness. The hot rolling was performed by a reheating temperature of 1050° C. and by 20 to 33 passes. The rolling was finished at the $Ar_3$ or more, then the plate was air-cooled, then acceleratedly cooled by water cooling.

Note that, the final step in the hot rolling, that is, the rolling from $Ar_3$+60° C. or less to the end, is called "strain-introducing rolling". The reduction ratio from $Ar_3$+60° C. or less to the end, that is, the reduction ratio of the strain-introducing rolling, was made at least 1.5. After air-cooling, water cooling (accelerated cooling) was started from various temperatures. The number of passes of the strain-introducing rolling was made 4 to 20.

The obtained steel plate was measured for the area percentage of polygonal ferrite using an optical microscope and was subjected to a tensile test and drop weight tear test (DWTT). The tensile properties were evaluated using a test piece of the API standard. The DWTT was performed at −60° C. and the shear area (SA) was investigated.

Figure 2:
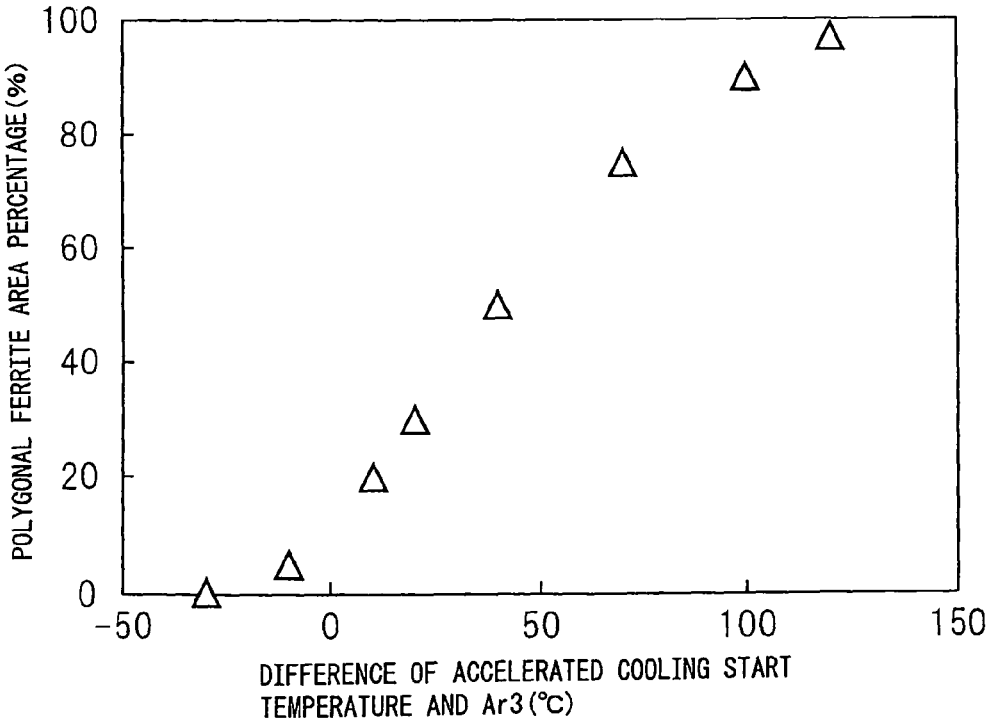
FIG. 2 is a view showing the relationship between a water cooling start temperature and a polygonal ferrite area percentage.

The relationship between the start temperature of the accelerated cooling and the area percentage of polygonal ferrite is shown in FIG. 2. From FIG. 2, it is learned that if making the start temperature of the accelerated cooling after hot rolling $Ar_3$−100° C. to $Ar_3$−10° C., the area percentage of polygonal ferrite of the steel plate becomes 20 to 90%. That is, if, after the end of hot rolling, air cooling from a temperature of the $Ar_3$ or more down to a temperature in the range of $Ar_a$−100° C. to $Ar_3$−10° C., an area percentage of 20 to 90% of polygonal ferrite can be formed.

Figure 3:
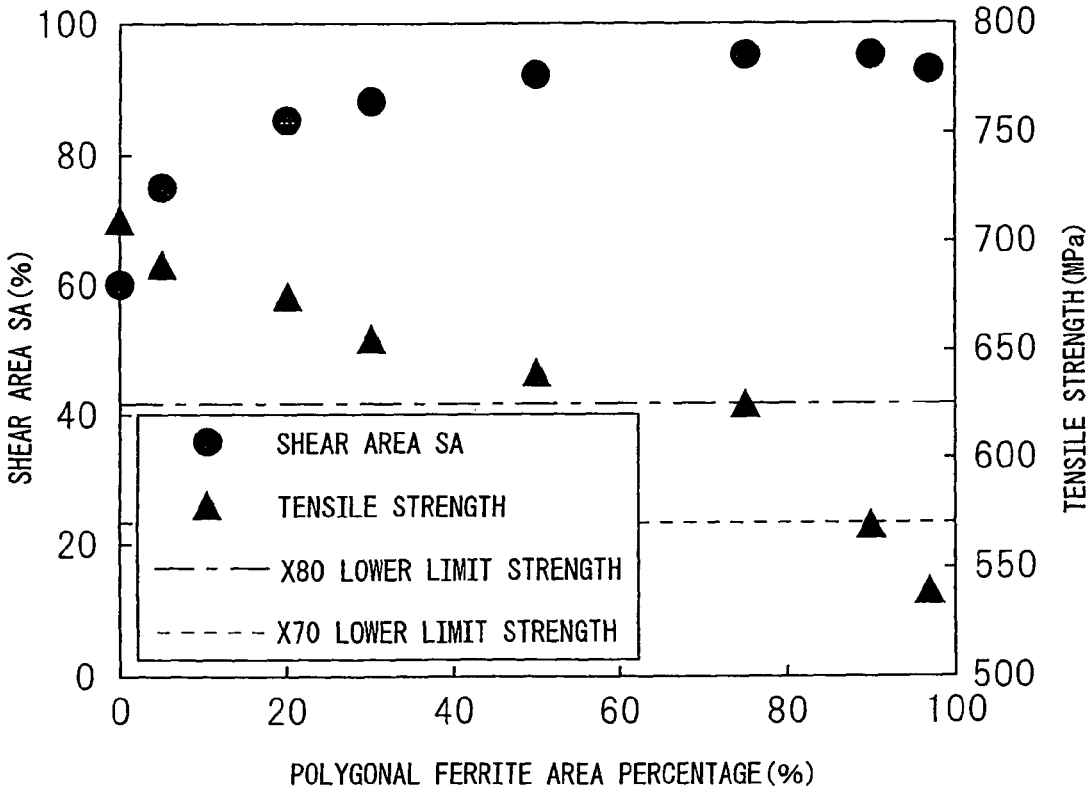
FIG. 3 is a view showing the relationship between a polygonal ferrite area percentage and a toughness and strength.

Further, the relationship between the area percentage of polygonal ferrite and the tensile strength and shear area (SA) at −60° C. is shown in FIG. 3. From FIG. 3, it is learned that if making the area percentage of polygonal ferrite 20% or more, an extremely good low temperature toughness can be obtained. Further, from FIG. 3, it is learned that to secure a tensile strength of 570 MPa or more, corresponding to X70, the area percentage of polygonal ferrite must be made not more than 90%. Furthermore, as shown in FIG. 3, to secure a tensile strength of 625 MPa or more, corresponding to X80, the area percentage of polygonal ferrite is preferably made not more than 80%.

As explained above, the inventors discovered that to secure polygonal ferrite, when hot rolling, it is important to introduce strain by rolling in the non-recrystallization region. The inventors engaged in further detailed studies and obtained the following discoveries to thereby complete the present invention.

In the hot rolling, it is important to secure the reduction ratio at not more than $Ar_3$+60° C. For this reason, as the final step in the hot rolling, strain-introducing rolling has to be performed. Strain-introducing rolling is comprised of the passes up to the end of rolling at not more than $Ar_3$+60° C. in the hot rolling. At least one pass is necessary. Several passes are also possible. To promote the formation of polygonal ferrite by the air-cooling after hot rolling, the reduction ratio of the strain-introducing rolling is made not less than 1.5. Note that, the reduction ratio of the strain-introducing rolling is the ratio of the plate thickness at $Ar_3$+60° C. and the plate thickness after the end of rolling.

After the rolling, the plate is air-cooled to cause the formation of polygonal ferrite, then, to improve the strength by bainite transformation, the plate is cooled by a 10° C./s or more cooling rate in accelerated cooling. Further, to secure the strength, the accelerated cooling has to be made to stop at the bainite formation temperature Bs or less.

Below, the steel plate of the present invention will be explained in more detail. Note that, % means mass %.

C: 0.01 to 0.08%

C is an element which improves the strength of steel. To promote the formation of a hard phase comprised of one or both of bainite and martensite in the metal structure, at least 0.01% has to be added. Further, in the present invention, to obtain both high strength and high toughness, the content of C is made not more than 0.08%.

Si: 0.01 to 0.50%

Si is a deoxidizing element. To obtain this effect, addition of at least 0.01% is required. On the other hand, if including over 0.50% of Si, the HAZ toughness deteriorates, so the upper limit is preferably made 0.50%.

Mn: 0.5 to 2.0%

Mn is an element improving the hardenability. To secure strength and toughness, addition of at least 0.5% is necessary. On the other hand, if the content of Mn exceeds 2.0%, the HAZ toughness is lowered. Therefore, the content of Mn is made 0.50 to 2.0%.

P: 0.050% or less

P is an impurity. If over 0.050% is included, the base metal remarkably deteriorates in toughness. To improve the HAZ toughness, the content of P is preferably made not more than 0.02%.

S: 0.0001 to 0.005%

S is an impurity. If over 0.005% is included, coarse sulfides are formed and the toughness is lowered.

Further, if the steel plate has oxides of Ti finely dispersed in it, MnS precipitates, intragranular transformation occurs, and the steel plate and HAZ are improved in toughness. To obtain this, it is necessary to include S in at least 0.0001%. Further, to improve the HAZ toughness, the upper limit of the amount of S is preferably made 0.003%.

Al: 0.020% or less

Al is a deoxidizing agent. To suppress the formation of inclusions and raise the toughness of the steel plate and HAZ, the upper limit has to be made 0.020%. By limiting the content of Al, it is possible to make the oxides of Ti, which contribute to intragranular transformation, finely disperse. To promote intragranular transformation, the amount of Al is preferably made not more than 0.010%. A more preferable upper limit is 0.008%.

Ti: 0.003 to 0.030% Ti is an element forming nitrides of Ti which contribute to the refinement of the grain size of the steel plate and HAZ. At least 0.003% has to be added. On the other hand, if Ti is included in excess, coarse inclusions are formed and the toughness is lowered, so the upper limit is preferably made 0.030%. Further, oxides of Ti, if finely dispersed, effectively act as nuclei for intragranular transformation.

If the amount of oxygen at the time of addition of Ti is large, coarse oxides of Ti are formed, so at the time of steelmaking, Si and Mn are preferably used for deoxidation to lower the amount of oxygen in advance. In this case, oxides of Al form more easily than oxides of Ti, so an excessive Al content is not preferable.

B: 0.0003 to 0.010%

B is an important element which remarkably raises the hardenability and, further, suppresses the formation of coarse grain boundary ferrite at the HAZ. To obtain this effect, it is necessary to add B in at least 0.0003%. On the other hand, if B is excessively added, coarse BN is formed. In particular, the HAZ toughness is lowered. Therefore, the upper limit of the amount of B is preferably made 0.010%.

Mo: 0.05 to 1.00%

Mo is an element which remarkably raises the hardenability—in particular by composite addition with B. To improve the strength and toughness, at least 0.05% is added. On the other hand, Mo is an expensive element. The upper limit of the amount of addition has to be made 1.00%.

O: 0.0001 to 0.008%

O is an impurity. To avoid a drop in toughness due to the formation of inclusions, the upper limit of its content has to be made 0.008%. To form oxides of Ti contributing to intragranular transformation, the amount of O remaining in the steel at the time of casting is made at least 0.0001%.

Furthermore, as elements for improving the strength and toughness, one or more of Cu, Ni, Cr, W, V, Nb, Zr, and Ta may be added. Further, when these elements are contained in less than the preferable lower limits of content, no particularly detrimental effect is given, so these may be viewed as impurities.

Cu and Ni are elements effective for raising the strength without detracting from the toughness. To obtain this effect, the lower limits of the amount of Cu and the amount of Ni are preferably made not less than 0.05%. On the other hand, the upper limit of the amount of Cu is preferably made 1.5% so as to suppress the occurrence of cracking at the time of heating the steel slab and at the time of welding. Ni, if included in excess, impairs the weldability, so the upper limit is preferably made 5.0%.

Note that, Cu and Ni are preferably included together for suppressing the formation of surface cracks. Further, from the viewpoint of the costs, the upper limits of Cu and Ni are preferably made 1.0%.

Cr, W, V, Nb, Zr, and Ta are elements which form carbides and nitrides and improve the strength of the steel by precipitation hardening. One or more may be included. To effectively raise the strength, the lower limit of the amount of Cr is preferably made 0.02%, the lower limit of the amount of W is preferably made 0.01%, the lower limit of the amount of V is preferably made 0.01%, the lower limit of the amount of Nb is preferably made 0.001%, and the lower limits of the amount of Zr and the amount of Ta are both preferably made 0.0001%.

On the other hand, if excessively adding one or both of Cr and W, the hardenability rises and thereby the strength rises and the toughness is lowered in some cases, so the upper limit of the amount of Cr is preferably made 1.50% and the upper limit of the amount of W is preferably made 0.50%. Further, if excessively adding one or more of V, Nb, Zr, and Ta, the carbides and nitrides will coarsen and the toughness will be lowered in some cases, so the upper limit of the amount of V is preferably made 0.10%, the upper limit of the amount of Nb is preferably made 0.20%, and the upper limits of the amount of Zr and the amount of Ta are both preferably made 0.050%.

Furthermore, to control the form of the inclusions and improve the toughness, one or more of Mg, Ca, REM, Y, Hf, and Re may be added. Further, these elements as well, if their contents are less than the preferable lower limits, do not have any particular detrimental effects, so can be regarded as impurities.

Mg is an element having an effect on refinement of the oxides or control of the form of the sulfides. In particular, fine oxides of Mg act as nuclei for intragranular transformation and, further, suppress the coarsening of the grain size as pinning particle. To obtain these effects, 0.0001% or more of Mg is preferably added. On the other hand, if adding over 0.010% of Mg, coarse oxides will be formed and the HAZ toughness will be lowered in some cases, so the upper limit of the amount of Mg is preferably made 0.010%.

Ca and REM are elements which are useful for controlling the form of the sulfides and which form sulfides to suppress the formation of MnS stretched in the rolling direction and thereby improve the characteristics of the steel material in the plate thickness direction, in particular the lamellar tear resistance. To obtain this effect, the lower limits of the amount of Ca and the amount of the REM are both preferably made 0.0001%. On the other hand, if one or both of Ca and REM exceeds a content of 0.005%, the oxides will increase, the fine Ti-containing oxides will be reduced, and intragranular transformation will be inhibited in some cases, so the contents are preferably made not more than 0.005%.

Y, Hf, and Re are also elements giving rise to advantageous effects similar to Ca and REM. If added in excess, they sometimes inhibit intragranular transformation. For this reason, the preferable ranges of the amounts of Y, Hf, and Re are 0.0001 to 0.005%.

Furthermore, in the present invention, in particular, to secure the HAZ hardenability and improve the toughness, the carbon equivalent Ceq of the following (formula 1), calculated from the contents (mass %) of C, Mn, Ni, Cu, Cr, Mo, and V, is made 0.30 to 0.53. It is known that the carbon equivalent Ceq is correlated with the maximum hardness of the weld zone and is a value forming a parameter of the hardenability and the weldability.

$$Ceq=C+Mn/6+(Ni+Cu)/15+(Cr+Mo+V)/5 \ldots \quad \text{(formula 1)}$$

Further, to secure the low temperature toughness of the steel plate and HAZ, the weld cracking sensitivity parameter Pcm of the following (formula 2), calculated from the contents of C, Si, Mn, Cu, Cr, Ni, Mo, V, and B (mass %), is made 0.10 to 0.20. The weld cracking sensitivity parameter Pcm is known as a coefficient enabling a guess of the low temperature cracking sensitivity at the time of welding and is a value forming a parameter of the hardenability and the weldability.

$$Pcm=C+Si/30+(Mn+Cu+Cr)/20+Ni/60+Mo/15+V/10+5B \ldots \quad \text{(formula 2)}$$

Note that, when the selectively included elements of Ni, Cu, Cr, and V are less than the above-mentioned preferable lower limits, they are impurities, so in the above (formula 1) and (formula 2), are calculated as "0".

The metal structure of the steel plate is made a multi phase structure including polygonal ferrite and a hard phase. Polygonal ferrite is ferrite formed at a relatively high temperature at the time of the air cooling after hot rolling. Polygonal ferrite has an aspect ratio of 1 to 4 and is differentiated from worked ferrite stretched by rolling and fine ferrite formed at the time of accelerated cooling at a relatively low temperature and insufficient in grain growth.

Note that, the hard phase is a structure comprised of one or both of bainite and martensite. In the structure of the steel plate observed under an optical microscope, as the balance other than the polygonal ferrite and the bainite and martensite, residual austenite and MA are sometimes included.

The area percentage of polygonal ferrite is made at least 20%. As explained above, in steel plate having a chemical composition raising the hardenability, by forming polygonal ferrite and making the balance a hard phase of bainite and martensite, the balance of the strength and toughness become good. In particular, by making the area percentage of polygonal ferrite at least 20%, as shown in FIG. 3, the low temperature toughness is remarkably improved. A DWTT at −60° C. showed that the SA can be made 85% or more.

On the other hand, to secure strength, the area percentage of polygonal ferrite has to be made not more than 90%. As shown in FIG. 3, by making the area percentage of polygonal ferrite not more than 90%, it is possible to secure a tensile strength corresponding to X70 or more. Furthermore, to raise the strength and secure a tensile strength corresponding to X80 or more, the area percentage of polygonal ferrite is preferably made not more than 80%.

Further, the balance other than the polygonal ferrite is a hard phase comprised of one or both of bainite and martensite. The area percentage of the hard phase becomes 10 to 80% since the area percentage of polygonal ferrite is 20 to 90%. On the other hand, for example, if the rolling end temperature falls below $Ar_3$ and the worked ferrite which has the aspect ratio exceeding 4 in is formed, the toughness will fall.

In the present invention, "polygonal ferrite" means the structure observed through an optical microscope, of whitish clump-like structures not containing coarse cementite or MA or other precipitates in the grains and with an aspect ratio of 1 to 4. Here, the "aspect ratio" is the length of the ferrite grains divided by the weight.

Further, "bainite" is defined as a structure in which carbides are precipitated between laths or clumps of ferrite or in which carbides are precipitated in the laths. Furthermore, "martensite" is a structure where carbides are not precipitated between the laths or in the laths. "Residual austenite" is austenite formed at a high temperature and remaining without transformation.

Next, the method of production for obtaining the steel plate of the present invention will be explained.

The above chemical compositions are ones which improve the toughness of the HAZ by raising the hardenability. To improve the low temperature toughness of the steel plate, it is necessary to control the hot rolling conditions and form ferrite. In particular, according to the present invention, even in case, like with steel plate of a thickness of 20 mm or more, it is difficult to raise the reduction ratio in the hot rolling process, ferrite can be formed by securing the reduction ratio at a relatively low temperature.

First, in the steelmaking process, the steel is smelted, then cast into a steel slab. The steel may be smelted and cast by ordinary methods, but continuous casting is preferable from the viewpoint of productivity. The steel slab is reheated for hot rolling.

The reheating temperature at the time of hot rolling is at least 950° C. This is because the hot rolling is performed at the temperature where the structure of the steel becomes a single phase of austenite, that is, the austenite region, and is meant to refine the crystal grain size of the base metal steel plate. The upper limit is not stipulated, but to suppress coarsening of the effective crystal grain size, the reheating temperature is preferably made not more than 1250° C. Note that, to raise the area percentage of polygonal ferrite, the upper limit of the reheating temperature is preferably made not more than 1050° C.

The reheated steel slab is hot rolled by several passes while controlling the temperature and reduction ratio. After this ends, it is air-cooled then cooled by accelerated cooling. Further, the hot rolling has to end at not less than the $Ar_3$ temperature where the structure of the base metal becomes a single phase of austenite. This is because if hot rolling at less than the $Ar_3$ temperature, worked ferrite is formed and the toughness deteriorations.

In the present invention, as the final step in the hot rolling, it is extremely important that strain-introducing rolling be performed. This is so as to introduce a large amount of strain for acting as sites for formation of polygonal ferrite in the not yet recrystallized austenite after the end of rolling end. "Strain-introducing rolling" is defined as the passes from not more than $Ar_3$+60° C. up to the end of rolling. The start temperature of the strain-introducing rolling is the temperature of the first pass at not more than $Ar_3$+60° C. The start temperature of the strain-introducing rolling is preferably a lower temperature of a temperature of not more than $Ar_3$+40° C.

The reduction ratio in the strain-introducing rolling is made at least 1.5 so as to cause the formation of polygonal ferrite at the time of air-cooling after hot rolling. In the present invention, the "reduction ratio in the strain-introducing rolling" is the ratio of the plate thickness at $Ar_3$+60° C. or the plate thickness at the start temperature of the strain-introducing rolling divided by the plate thickness after the end of the hot rolling. The upper limit of the reduction ratio is not stipulated, but if considering the thickness of the steel slab before rolling and the thickness of the base metal steel plate after rolling, it is usually 12.0 or less. To increase the area percentage of polygonal ferrite of the steel plate of the chemical composition improving the hardenability, the reduction ratio in the strain-introducing rolling is preferably made at least 2.0.

Note that, before the strain-introducing rolling, recrystallization rolling and non-recrystallization rolling may also be performed. "Recrystallization rolling" is rolling in the recrystallization region of over 900° C., while "non-recrystallization rolling" is rolling in the non-recrystallization region of up to 900° C. Recrystallization rolling may be started immediately after extracting the steel slab from the heating furnace, so the start temperature is not particularly defined. To refine the effective crystal grain size of the steel plate, the reduction ratio at the recrystallization rolling is preferably made not less than 2.0.

Furthermore, after the end of rolling, the steel plate is air-cooled and cooled by accelerated cooling. To form an area percentage of 20 to 90% of polygonal ferrite, the steel plate has to be air-cooled down to a temperature of less than $Ar_3$. Therefore, it is necessary to start the accelerated cooling at a temperature of $Ar_3$−100° C. to $Ar_3$−10° C. in range. Further, to suppress the formation of pearlite or cementite and secure tensile strength and toughness, the cooling rate in accelerated cooling has to be made at least 10° C./s. The accelerated cooling suppresses the formation of pearlite and cementite and promotes the formation of a hard phase comprised of one or both of bainite and martensite. The stop temperature must be not more than the Bs of (formula 3). Note that, "Bs" is the start temperature of the bainite transformation. It is known that it is calculated by (formula 3) from the contents of C, Mn, Ni, Cr, and Mo. If cooling by accelerated cooling down to a temperature of the Bs or less, bainite can be formed.

$$Bs(^\circ\,C.)=830-270C-90Mn-37Ni-70Cr-83Mo \ldots \quad \text{(formula 3)}$$

The lower limit of the water cooling stop temperature is not defined. The water cooling may be performed down to room temperature, but if considering the productivity and hydrogen defects, the limit is preferably made not less than 150° C.

EXAMPLES

Steels having the chemical compositions shown in Table 1 were smelted to form steel slabs having thicknesses of 240 mm. These steel slabs were hot rolled and cooled to produce steel plates under the conditions shown in Table 2. The $Ar_3$ of the steels were calculated by cutting out test pieces of heights of 12 mm and diameters of 8 mm from the smelted steel slabs, working and heat treating them simulating hot rolling, then measuring the heat expansion.

TABLE 1

| St. | Chemical composition (mass %) | | | | | | | | | | | |
|---|---|---|---|---|---|---|---|---|---|---|---|---|
| no. | C | Si | Mn | P | S | Al | Ti | Mo | B | O | N | Cu |
| A | 0.030 | 0.25 | 1.91 | 0.007 | 0.0018 | <0.002 | 0.011 | 0.1 | 0.0009 | 0.002 | 0.0026 | |
| B | 0.029 | 0.10 | 1.88 | 0.007 | 0.0007 | <0.002 | 0.012 | 0.1 | 0.0011 | 0.0017 | 0.0025 | |
| C | 0.043 | 0.26 | 1.96 | 0.007 | 0.0021 | 0.008 | 0.01 | 0.098 | 0.0009 | 0.002 | 0.003 | 0.06 |
| D | 0.049 | 0.20 | 1.86 | 0.008 | 0.0004 | 0.004 | 0.021 | 0.1 | 0.0009 | 0.0021 | 0.0035 | |
| E | 0.040 | 0.50 | 1.96 | 0.002 | 0.0023 | 0.005 | 0.01 | 0.1 | 0.001 | 0.0016 | 0.0027 | |
| F | 0.045 | 0.24 | 1.52 | 0.01 | 0.0004 | 0.005 | 0.02 | 0.05 | 0.0011 | 0.0015 | 0.0034 | |
| G | 0.020 | 0.11 | 2.00 | 0.003 | 0.0005 | 0.004 | 0.012 | 0.08 | 0.0012 | 0.0014 | 0.0032 | |
| H | 0.030 | 0.31 | 1.87 | 0.002 | 0.0009 | 0.005 | 0.014 | 0.2 | 0.0006 | 0.0023 | 0.003 | |
| I | 0.043 | 0.23 | 2.00 | 0.004 | 0.002 | 0.001 | 0.008 | 0.4 | 0.0011 | 0.002 | 0.0027 | |
| J | 0.051 | 0.06 | 1.88 | 0.005 | 0.0023 | 0.05 | 0.013 | 0.05 | 0.0001 | 0.0015 | 0.0032 | |
| K | 0.030 | 0.10 | 1.20 | 0.008 | 0.0023 | 0.002 | 0.012 | 1.5 | 0.0011 | 0.0024 | 0.003 | |
| L | 0.050 | 0.25 | 1.90 | 0.007 | 0.0015 | 0.003 | 0.008 | | 0.0007 | 0.0025 | 0.0024 | |

TABLE 1-continued

| St. no. | Chemical composition (mass %) Ni | Cr | V | Nb | Zr, Ta | Mg, Ca, REM, Y, Hf, Re, W | Ceq | Pcm | Bs ° C. | Remarks |
|---|---|---|---|---|---|---|---|---|---|---|
| A | | | | | | | 0.37 | 0.15 | 645 | Inv. |
| B | | | | 0.012 | | | 0.36 | 0.14 | 642 | ex. |
| C | 0.06 | | | | | Hf: 0.0010<br>Re: 0.0010 | 0.40 | 0.16 | 632 | |
| D | | | | 0.029 | | W: 0.16 | 0.38 | 0.16 | 641 | |
| E | | | 0.04 | 0.03 | | Y: 0.001 | 0.39 | 0.17 | 635 | |
| F | | | | | Ta: 0.0003 | Ca: 0.0006<br>REM: 0.0006 | 0.31 | 0.14 | 677 | |
| G | | | | 0.012 | | Ca: 0.0017<br>REM: 0.001 | 0.37 | 0.14 | 638 | |
| H | | | 0.025 | 0.01 | Zr: 0.04 | | 0.39 | 0.15 | 635 | |
| I | 0.1 | 0.03 | 0.043 | 0.031 | Zr: 0.001 | | 0.48 | 0.19 | 599 | |
| J | | 0.25 | 0.046 | 0.012 | Zr: 0.001 | | 0.43 | 0.17 | 625 | Comp. |
| K | | | | 0.014 | | Mg: 0.002 | 0.53 | 0.20 | 605 | ex. |
| L | | | 0.05 | 0.02 | | Mg: 0.0020 | 0.38 | 0.16 | 607 | |

*Ceq = C + Mn/6 + (Ni + Cu)/15 + (Cr + Mo + V)/5

*Pcm = C + Si/30 + (Mn + Cu + Cr)/20 + Ni/60 + Mo/15 + V/10 + 5B

*Empty fields in composition mean not added

*Underlines in table mean outside scope of present invention

TABLE 2

| Production no. | Steel no. | $Ar_3$ ° C. | Reheating temp. ° C. | Strain-introducing rolling: Start temp. ° C. | Reduction ratio | Rolling end temp. ° C. | Accelerated cooling: Start temp. ° C. | Stop temp. ° C. | Cooling rate ° C./s | Final plate thick. mm | Remarks |
|---|---|---|---|---|---|---|---|---|---|---|---|
| 1 | A | 770 | 1050 | 60 | 5 | 20 | −40 | 267 | 21 | 20 | Inv. ex. |
| 2 | A | 770 | 1050 | 60 | 4 | 10 | −60 | 160 | 23 | 20 | |
| 3 | A | 770 | 950 | 40 | 2 | 20 | −30 | 235 | 13 | 30 | |
| 4 | A | 770 | 1050 | 60 | 4 | 10 | −105 | 220 | 28 | 25 | Comp. ex. |
| 5 | A | 770 | 1050 | 60 | 5 | 5 | −90 | 412 | 8 | 25 | |
| 6 | B | 765 | 1050 | 60 | 4 | 20 | −10 | 230 | 24 | 20 | Inv. ex. |
| 7 | B | 765 | 1000 | 40 | 4 | 15 | −35 | 234 | 26 | 25 | |
| 8 | B | 765 | 1050 | 60 | 4.5 | −40 | −80 | 185 | 17 | 30 | Comp. ex. |
| 9 | B | 765 | 1050 | 60 | 4 | 10 | 35 | 194 | 29 | 25 | |
| 10 | C | 765 | 1050 | 60 | 5 | 10 | −56 | 236 | 22 | 20 | Inv. ex. |
| 11 | C | 765 | 1100 | 60 | 1.4 | 50 | −30 | 263 | 25 | 30 | Comp. ex. |
| 12 | D | 760 | 1050 | 60 | 4 | 20 | −10 | 230 | 24 | 20 | Inv. ex. |
| 13 | D | 760 | 1100 | 60 | 4 | 10 | 40 | 202 | 26 | 25 | Comp. ex. |
| 14 | E | 760 | 950 | 60 | 4 | 15 | −40 | 240 | 25 | 25 | Inv. ex. |
| 15 | E | 760 | 1050 | 60 | 4 | 20 | 0 | 221 | 28 | 25 | Comp. ex. |
| 16 | F | 760 | 1050 | 60 | 5 | 10 | −60 | 235 | 20 | 20 | Inv. ex. |
| 17 | G | 770 | 1050 | 40 | 3 | 20 | −15 | 202 | 23 | 20 | |
| 18 | H | 765 | 950 | 60 | 5 | 15 | −60 | 213 | 19 | 20 | |
| 19 | I | 760 | 950 | 60 | 5 | 10 | −60 | 250 | 18 | 25 | |
| 20 | J | 760 | 1000 | 60 | 4 | 10 | −60 | 450 | 11 | 20 | Comp. ex. |
| 21 | K | 765 | 1050 | 60 | 3 | 20 | −40 | 205 | 20 | 25 | |
| 22 | L | 760 | 1050 | 60 | 4 | 5 | −80 | 220 | 23 | 25 | |

*Reduction ratio is (plate thickness before start of strain-introducing rolling)/(final plate thickness)

*Rolling end temperature, water cooling start temperature, and water cooling step temperature are different from $Ar_3$.

*Underlines in table mean outside scope of present invention

The microstructures of the steel plates at the center parts of plate thickness were observed under an optical microscope and were measured for area percentages of the polygonal ferrite and the balance of bainite and martensite. Furthermore, from the steel plates, based on the API, 5L3, ASTM, and E436, press notch test pieces having plate width directions as their long directions and provided with notches parallel to the plate width direction were prepared. DWTTs were performed at −60° C. to find the SAs. The tensile properties were evaluated using test pieces of the API standards. The results are shown in Table 3.

TABLE 3

| Production run no. | Steel no. | Metal structure area percentage (%): Polygonal ferrite | Hard phase | Tensile strength MPa | Shear area (SA) % | Remarks |
|---|---|---|---|---|---|---|
| 1 | A | 60 | 40 | 641 | 93 | Inv. ex. |
| 2 | A | 85 | 15 | 623 | 95 | |
| 3 | A | 35 | 65 | 636 | 85 | |
| 4 | A | 92 | 8 | 565 | 95 | Comp. ex. |
| 5 | A | 83 | 7 | 555 | 95 | |
| 6 | B | 55 | 45 | 645 | 87 | Inv. ex. |

TABLE 3-continued

| Production run no. | Steel no. | Metal structure area percentage (%) Polygonal ferrite | Hard phase | Tensile strength MPa | Shear area (SA) % | Remarks |
|---|---|---|---|---|---|---|
| 7 | B | 35 | 65 | 670 | 85 | |
| 8 | B | 11 | 45 | 642 | 75 | Comp. ex. |
| 9 | B | 5 | 95 | 710 | 53 | |
| 10 | C | 65 | 35 | 640 | 92 | Inv. ex. |
| 11 | C | 9 | 91 | 688 | 80 | Comp. ex. |
| 12 | D | 55 | 45 | 663 | 90 | Inv. ex. |
| 13 | D | 2 | 98 | 730 | 54 | Comp. ex. |
| 14 | E | 45 | 55 | 645 | 89 | Inv. ex. |
| 15 | E | 8 | 92 | 670 | 75 | Comp. ex. |
| 16 | F | 60 | 40 | 645 | 89 | Inv. ex. |
| 17 | G | 54 | 46 | 624 | 90 | |
| 18 | H | 42 | 58 | 642 | 87 | |
| 19 | I | 40 | 60 | 652 | 86 | |
| 20 | J | 93 | 7 | 546 | 100 | Comp. ex. |
| 21 | K | 2 | 98 | 715 | 60 | |
| 22 | L | 91 | 9 | 568 | 95 | |

*Underlines in the table mean outside scope of present invention.

Production Run Nos. 1 to 3, 6, 7, 10, 12, 14, and 16 to 19 are invention examples which have polygonal ferrite of aspect ratios of 1 to 4 in area percentages of 20 to 90%. These are steel plates with excellent low temperature toughness which satisfy strengths of X70 or better, further X80 or better, and have SAs by DWTTs of 85% or more.

These steel plates were formed into pipe shapes by a UO process, welded by submerged arc welding at the abutting parts from the inside and outside surfaces, and then expanded to produce steel pipes. These steel pipes had structures similar to those of the steel plates, had strengths 20 to 30 MPa higher than the steel plates, and had low temperature toughnesses similar to the steel plates.

On the other hand, Production Run No. 4 is an example where the start temperature of the accelerated cooling is low, the area percentage of the ferrite increases, and the strength falls. Further, Production Run No. 5 is an example where the cooling rate of the accelerated cooling is slow, the hard phase for securing the strength cannot be obtained, and the strength falls. Production Run No. 8 is an example where the rolling end temperature was below the $Ar_3$, so worked ferrite with an aspect ratio of over 4 was formed, the polygonal ferrite was reduced, and the low temperature toughness fell.

Note that, in Production Run No. 8, the balance other than the polygonal ferrite and the hard phase is comprised of ferrite with an aspect ratio of over 4.

Production Run Nos. 9, 13, and 15 are examples where the starting temperatures of accelerated cooling are high, while Production Run No. 11 is an example where the reduction ratio of the strain-introducing rolling is low, formation of ferrite was insufficient, and the toughness fell.

Further, Production Run Nos. 20 to 22 are comparative examples with chemical compositions outside the scope of the present invention. Production Run No. 20 has a small amount of B, while Production Run No. 22 has no Mo added, so are examples where, under the production conditions of the present invention, the polygonal ferrite increases and the strength falls. Production Run No. 21 is an example with a large amount of Mo, so is an example where, even under the production conditions of the present invention, the area percentage of polygonal ferrite is low and the toughness deteriorations.

INDUSTRIAL APPLICABILITY

According to the present invention, it becomes possible to promote the formation of polygonal ferrite in the metal structure of high strength steel plate having a chemical composition obtained by controlling the carbon equivalent Ceq and weld cracking sensitivity parameter Pcm and further adding B and Mo to raise the hardenability. Due to this, high strength steel plate improved in strength and HAZ toughness, extremely excellent in low temperature toughness as well, and having a metal structure comprised of polygonal ferrite and a hard phase, furthermore, high strength using this as a base metal and methods of production of the same can be provided. The contribution to industry is extremely remarkable.

The invention claimed is:

1. High strength steel plate with excellent low temperature toughness, having a chemical composition containing, by mass %, C: 0.01 to 0.08%,
Si: 0.01 to 0.50%,
Mn: 0.5 to 2.0%,
S: 0.0001 to 0.005%,
Ti: 0.003 to 0.030%,
Mo: 0.05 to 1.00%,
B: 0.0003 to 0.010%, and
0: 0.0001 to 0.008%,
limiting
P: 0.050% or less and
Al: 0.020% or less, and
having a balance of iron and unavoidable impurities,
having a Ceq, calculated by the following (formula 1), of 0.30 to 0.53,
having a Pcm, found the following (formula 2), of 0.10 to 0.20, and
having a metal structure with an area percentage of polygonal ferrite of 20 to 90% and a balance of a hard phase comprised of one or both of bainite and martensite:

$$Ceq=C+Mn/6+(Ni+Cu)/15+(Cr+Mo+V)/5 \ldots \quad \text{(formula 1)}$$

$$Pcm=C+Si/30+(Mn+Cu+Cr)/20+Ni/60+Mo/15+V/10+5B \ldots \quad \text{(formula 2)}$$

where, C, Si, Mn, Ni, Cu, Cr, Mo, V, and B are contents of the individual elements (mass %).

2. High strength steel plate with excellent low temperature toughness as set forth in claim 1, further containing, by mass %, one or both of Cu: 0.05 to 1.5% and
Ni: 0.05 to 5.0%.

3. High strength steel plate with excellent low temperature toughness as set forth in claim 1, further containing, by mass %, one or more of Cr: 0.02 to 1.50%,
W: 0.01 to 0.50%,
V: 0.01 to 0.10%,
Nb: 0.001 to 0.20%,
Zr: 0.0001 to 0.050%, and
Ta: 0.0001 to 0.050%.

4. High strength steel plate with excellent low temperature toughness as set forth in claim 1, further containing, by mass %, one or more of Mg: 0.0001 to 0.010%,
Ca: 0.0001 to 0.005%,
REM: 0.0001 to 0.005%,
Y: 0.0001 to 0.005%,
Hf: 0.0001 to 0.005%, and
Re: 0.0001 to 0.005%.

5. High strength steel plate with excellent low temperature toughness as set forth in claim 1, characterized by having a metal structure with an area percentage of polygonal ferrite of 20 to 80%.

6. High strength steel pipe with excellent low temperature toughness characterized by having a base metal comprised of steel plate as set forth in claim 1.

7. A method of production of high strength steel plate with excellent low temperature toughness characterized by taking a steel slab comprised of the chemical compositions as set forth in claim 1, reheating it to 950° C. or more, hot rolling it, performing, as the final step in said hot rolling, strain-introducing rolling with a start temperature of not more than Ar3+60° C., and end temperature of not less than Ar3, and a reduction ratio of not less than 1.5, then air-cooling, then acceleratedly cooling from Ar3-100° C. to Ar3-10° C. in temperature by a 10° C/s or more cooling rate until a temperature of not more than a Bs calculated by the following (formula 3)

$$Bs(^\circ\,C.)=830-270C-90Mn-37Ni-70Cr-83Mo \ldots \quad \text{(formula 3)}$$

where, C, Mn, Ni, Cr, and Mo are contents of the individual elements (mass %).

8. A method of production of high strength steel pipe with excellent low temperature toughness characterized by forming steel plate produced by the method as set forth in claim 7 into a pipe shape by a UO process, welding the abutting parts from the inside and outside surfaces by submerged arc welding, then expanding the pipe.

* * * * *

UNITED STATES PATENT AND TRADEMARK OFFICE

CERTIFICATE OF CORRECTION

PATENT NO. : 8,110,292 B2
APPLICATION NO. : 12/736359
DATED : February 7, 2012
INVENTOR(S) : Taishi Fujishiro et al.

It is certified that error appears in the above-identified patent and that said Letters Patent is hereby corrected as shown below:

First page under (22) PCT Filed:, change "April 4, 2009" to -- April 7, 2009 --;

Column 15, line 10, change "Ar3+60°C., and end temperature of not less than Ar3," to -- $Ar_3$+60°C., and end temperature of not less than $Ar_3$, --;

Column 15, line 12, change "Ar3-100° C. to Ar3-10° C." to -- $Ar_3$-100° C. to $Ar_3$-10° C. --.

Signed and Sealed this
Nineteenth Day of February, 2013

Teresa Stanek Rea
*Acting Director of the United States Patent and Trademark Office*